US006477816B1

(12) United States Patent
Di Biase

(10) Patent No.: US 6,477,816 B1
(45) Date of Patent: Nov. 12, 2002

(54) PIT FORM

(75) Inventor: Joseph J. Di Biase, Richmond Hill (CA)

(73) Assignee: Frommelt Industries of Canada, Inc., Vaughan (CA)

( * ) Notice: Subject to any disclaimer, the term of this patent is extended or adjusted under 35 U.S.C. 154(b) by 0 days.

(21) Appl. No.: 09/293,161

(22) Filed: Apr. 16, 1999

(51) Int. Cl.[7] ..... E04B 2/00

(52) U.S. Cl. ..... 52/588.1; 52/581; 52/656.1; 52/656.9

(58) Field of Search ..... 52/60, 173.2, 800.1, 52/800.11, 800.18, 656.1, 656.2, 656.9, 581, 588.1, 649.1; 14/71.1, 71.5, 285.3, 285.4, 281, 588.1, 581

(56) References Cited

U.S. PATENT DOCUMENTS

| | | | | |
|---|---|---|---|---|
| 1,363,187 | A | | 12/1920 | Miller |
| 3,393,521 | A | | 7/1968 | Cammisa |
| 3,713,257 | A | | 1/1973 | Beavers |
| 3,990,204 | A | | 11/1976 | Haworth et al. |
| 4,014,059 | A | | 3/1977 | Artzberger et al. |
| 4,022,420 | A | | 5/1977 | Pace |
| 4,028,901 | A | | 6/1977 | Barber |
| 4,194,717 | A | | 3/1980 | Easton et al. |
| 4,241,965 | A | | 12/1980 | Wilson et al. |
| 4,259,029 | A | | 3/1981 | Koehl |
| 4,277,123 | A | | 7/1981 | Haworth et al. |
| 4,365,451 | A | | 12/1982 | Nelson |
| 4,367,370 | A | | 1/1983 | Wilson et al. |
| 4,401,291 | A | | 8/1983 | Gallis |
| 4,449,858 | A | | 5/1984 | Hynds |
| 4,485,602 | A | | 12/1984 | Flamboe et al. |
| 4,530,622 | A | | 7/1985 | Mercer |
| 4,596,098 | A | | 6/1986 | Finkbeiner et al. |
| 4,644,992 | A | | 2/1987 | Jerila |
| 4,666,223 | A | | 5/1987 | Tillmann |
| 4,679,762 | A | | 7/1987 | Lee et al. |
| 4,685,837 | A | | 8/1987 | Cicanese |
| 4,703,985 | A | | 11/1987 | Finkbeiner et al. |
| 4,742,985 | A | | 5/1988 | Mathis |
| 4,775,125 | A | | 10/1988 | Pfeifer |
| 4,846,437 | A | | 7/1989 | Fitzgerald |
| 4,898,358 | A | | 2/1990 | Spronken |
| 4,991,999 | A | | 2/1991 | Helms |
| 4,993,205 | A | | 2/1991 | Dull et al. |
| 4,996,811 | A | | 3/1991 | Dull et al. |
| 5,033,526 | A | | 7/1991 | DeLong et al. |
| 5,054,255 | A | | 10/1991 | Maninfior |
| 5,055,252 | A | * | 10/1991 | Zimmerman ..... 52/309.12 |
| 5,078,360 | A | | 1/1992 | Spera |
| 5,096,155 | A | | 3/1992 | Fitzgerald |
| 5,154,541 | A | | 10/1992 | Boren et al. |
| 5,158,398 | A | | 10/1992 | Pinho |
| 5,313,681 | A | * | 5/1994 | Alexander ..... 14/71.1 |
| 5,396,676 | A | * | 3/1995 | Alexander ..... 14/71.1 |
| 5,408,789 | A | * | 4/1995 | Plfeger ..... 52/173.2 |
| 5,442,825 | A | * | 8/1995 | Hahn ..... 14/71.1 |
| 5,465,533 | A | * | 11/1995 | Rummo ..... 52/60 |
| 5,542,219 | A | | 8/1996 | Dias |
| 5,551,808 | A | | 9/1996 | Sandanasamy et al. |
| 5,552,103 | A | | 9/1996 | Lee |
| 5,625,989 | A | | 5/1997 | Brubaker et al. |
| 5,737,896 | A | * | 4/1998 | Rodgers ..... 52/309.12 |
| 5,758,463 | A | * | 6/1998 | Mancini ..... 52/309.12 |
| 5,833,873 | A | | 11/1998 | Adonetti |
| 5,896,711 | A | * | 4/1999 | McClure ..... 52/200 |
| 6,067,759 | A | * | 5/2000 | House ..... 52/198 |
| 6,070,283 | A | * | 6/2000 | Hahn ..... 14/71.1 |
| 6,079,181 | A | * | 6/2000 | Ruff ..... 52/204.1 |
| 6,106,191 | A | * | 8/2000 | Achenbach ..... 14/71.1 |

* cited by examiner

*Primary Examiner*—Beth A. Stephan
(74) *Attorney, Agent, or Firm*—Kitt Sinden; Marcelo K. Sarkis; Ivor M. Hughes

(57) ABSTRACT

A pit form comprising two substantially parallel side members having two ends and a substituting perpendicular rear member extending between proximate the same ends of the side members in use, each of the side members and the rear member having compatible male and female engaging portions to interconnect said members to form said pit form.

30 Claims, 15 Drawing Sheets

PIT FORM

FIELD OF THE INVENTION

The present invention relates generally to the field of concrete forming structures and more particularly, to a system of interconnecting panel members for assembling a concrete forming structure which structure is especially suited to the construction of loading dock pits and the like.

BACKGROUND OF THE INVENTION

In the shipment of cargo by tractor trailers and the like, cargo is typically loaded and unloaded at a dock. The trailer is backed into and abuts bumpers secured to the dock face. The cargo is transferred between the trailer and the dock by fork lift trucks or similar vehicles. The bumpers result in a gap between the edge of the dock and the edge of the trailer. As well, truck trailers have a variety of bed heights and thus, the floor of the trailer bed is usually not level with the floor of the dock. Dock levelers are utilized to bridge the gap between a dock platform and the bed of a parked trailer, whether or not there is a height difference, by providing a flat, uniform surface for vehicular and pedestrian traffic between the dock and the inside of the trailer during loading and unloading operations. A typical dock leveler is mounted within a pit formed in the platform surface of the loading dock. The loading dock pit of a conventional construction is defined by having a recessed horizontal base surface, upright side and rear walls and an open front.

Conventionally it has been known to provide concrete forming structures for loading dock pits and the like, comprising wooden forms for contact with the poured concrete. Such forming structures support the newly poured concrete walls throughout the curing period of the concrete.

The known concrete forming structures generally include a plurality of individual wooden sheets to provide a molding surface or facing against which the concrete is to be poured; the sheets being fastened or otherwise secured to a form framing structure which may comprise a number of structural elements such as load-bearing studs, beams or joists, as is well known to those skilled in this art. In the case of a typical wall form, the structural elements therefor comprise a plurality of vertical wooden studs to which the wooden sheeting is nailed or otherwise secured, the studs being in turn backed-up by a plurality of horizontal wooden studs. In many cases, the conventional wall forms further require a plurality of wooden braces which are disposed between the parallel faces of the assembled form and are intended to provide greater structural integrity to the forming structure.

The prior art forms of the type discussed above are generally custom made to suit a particular concrete pouring operation, thereby requiring considerable cutting and fitting of the numerous constituent parts of the forming structure and calling for skilled labour for the assembly thereof. Once the poured concrete has set, these known forms are dismantled and stripped away from the hardened concrete, resulting in a substantial amount of ruined lumber parts and metal fitting or fasteners which cannot be reused in subsequent concrete forming operations. It may therefore be appreciated that the conventional concrete pouring structures, characterized by formwork constructed from wood, is cost intensive from the perspective of both labour and materials. Assembly and disassembly of the various constituent components is both difficult and time consuming.

A number of concrete pouring systems consisting of prefabricated component parts have been developed over the years in an attempt to alleviate the various problems associated with the conventional concrete forming structures described above. However, such prefabricated formwork systems require numerous pieces of hardware such as nails, bolts, ties, wedges and the like for assembly. Other systems of this prefabricated type are composed of a rather large number of constituent parts which necessitates that manufacturers, suppliers or users thereof stock an excessive inventory in order to be able assemble a broad variety of concrete forming structures for the commonly encountered sizes of loading dock pits. Some of the known systems do not adequately provide for accurate alignment of the modular elements thereof, with the result that offsets, e.g. ridges, creases or other like markings, are formed in the finished concrete from panel members which do not properly align at their joints.

Applicant is aware of one such prefabricated concrete forming system currently on the market called Perma Pit made by Perma Tech Inc. Perma Pit has two steel sides and one steel back member which bolt together to act as a permanent pit form for a conventional loading dock pit. Perma Pit requires numerous pieces of hardware for assembly and does not adequately provide for accurate alignment of the elements thereof.

It is accordingly one object of the present invention to provide a form that can be used for casting an open ended loading dock pit having parallel side walls, a rear end wall and a bottom, said form avoiding the disadvantages of the prior art structures.

It is accordingly another object of the present invention to provide a system of interconnecting panels for assembling a broad variety of sizes of concrete forming structures, wherein the elements thereof consist of a reduced number of constituent parts, such that manufactures, suppliers or users of the present invention need not stock an excessive inventory in order to be able to assemble the commonly encountered sizes and configurations of pouring structures in the loading dock construction field.

It is a further object of the invention to provide a system of prefabricated components for a concrete pouring structure which is fast and easy to assemble and which may be assembled by semi-skilled or unskilled labour at the building site.

It is yet another object of the present invention to provide an assembly for concrete forming which ensures accurate, speedy and facile alignment of the elements thereof so that offsets or other imperfections may be avoided in the finished concrete surfaces.

It is yet another object of the present invention to provide a prefabricated system for concrete forming structures comprising relatively compact elements which can be conveniently stored and transported to the work site.

Still a further object of the invention is to provide an assembly for concrete forming whose constituent parts are relatively lightweight, strong and rigid.

It is still a further object of the invention to provide a pit form which is easy to use and quick to set up, saving time and expense.

Further and other objects of the invention will become apparent to those skilled in the art from reading the following summary of the invention and the preferred embodiments described and illustrated herein.

SUMMARY OF THE INVENTION

According to one aspect of the invention, there is provided a pit form comprising two substantially parallel side members having two ends and a substantially perpendicular rear member extending between proximate the same ends of the side members in use, each of the side members and the rear member having compatible male and female engaging portions to interconnect said members to form said pit form, preferably said male and female engaging portions are at least one hook and slot respectively, preferably a plurality of hooks and slots, and preferably the male and female engaging portions are integral with said side members and rear member, preferably said male and female portions further provide for substantial alignment and securement of said side members with said rear member.

In a preferred embodiment of the above-mentioned invention, there is provided a pit form comprising:

(a) a first side panel having a top, a bottom, a first end, a second end, an outer face for contact with poured concrete to form a mold surface therefor, an opposite inner face for lining said pit, and at least one connector located proximate at least one end thereof;

(b) a second side panel arranged in a substantially parallel relationship to said first side panel, said second side panel having a top, a bottom, a first end, a second end, an outer face for contact with poured concrete to form a mold surface therefor, an opposite inner face for lining said pit, and at least one connector located proximate at least one end thereof;

(c) a rear panel having a top, a bottom, a first end, a second end, an outer face for contact with poured concrete to form a mold surface therefor, an opposite inner face for lining said pit, and at least one connector receiver for receiving each of said at least one connector of each of said first and said second side panels; whereby when each of said at least one connector of each of said first and said second side panels is received within said at least one connector receiver, said rear panel is arranged substantially perpendicular to each of said first and said second side panels and said second side panel is arranged substantially parallel to said first side panel and is located at a predetermined distance therefrom.

Preferably the at least one connector of each of said first and said second side panels is located proximate the second end of each of said first and said second side panels, said pit form further comprising a side panel connector for connecting each of said first and said second side panels proximate the first end of each of said first and said second side panels.

Preferably:

(a) said top of said first side panel further comprises a flange extending substantially normal to said outer face and said bottom of said first side panel further comprises a flange extending substantially normal to said inner face;

(b) said top of said second side panel further comprises a flange extending substantially normal to said outer face and said bottom of said second side panel further comprises a flange extending substantially normal to said inner face; and (c) said top of said rear panel further comprises a flange extending substantially normal to said outer face and said bottom of said rear panel further comprises a flange extending substantially normal to said inner face.

Preferably the pit form further comprising at least one stabilizer on at least one of said panels.

In one aspect of the invention the side panel connector further comprises at least one stabilizer, preferably substantially rectangular in shape.

Preferably the pit form further comprises at least one mounting plate, proximate said first end of at least one of said first and said second side panels, and preferably proximate said side panel connector, and preferably said at least one mounting plate is substantially normal to said first end of at least one of said first and said second side panels.

In one embodiment of the inventions discussed above, the pit form further comprises at least one bumper located thereon, preferably located on said at least one mounting plate.

Preferably, there is provided the use of a pit form for forming a pit for a loading dock, preferably in combination with a loading dock, said pit form comprising:

(a) a first side panel having a top, a bottom, a first end, a second end, an outer face for contact with poured concrete to form a mold surface therefor, an opposite inner face for lining said pit, and at least one connector located proximate at least one end thereof;

(b) a second side panel arranged in a substantially parallel relationship to said first side panel, said second side panel having a top, a bottom, a first end, a second end, an outer face for contact with poured concrete to form a mold surface therefor, an opposite inner face for lining said pit, and at least one connector located proximate at least one end thereof;

(c) a rear panel having a top, a bottom, a first end, a second end, an outer face for contact with poured concrete to form a mold surface therefor, an opposite inner face for lining said pit, and at least one connector receiver for receiving each of said at least one connector of each of said first and said second side panels; whereby when each of said at least one connector of each of said first and said second side panels is received within said at least one connector receiver, said rear panel is arranged substantially perpendicular to each of said first and said second side panels and said second side panel is arranged substantially parallel to said first side panel and is located at a predetermined distance therefrom.

Preferably the at least one connector of each of said first and said second side panels is located proximate the second end of each of said first and said second side panels, said pit form further comprising a side panel connector for connecting each of said first and said second side panels proximate the first end of each of said first and said second side panels.

Preferably:

(a) said top of said first side panel further comprises a flange extending substantially normal to said outer face and said bottom of said first side panel further comprises a flange extending substantially normal to said inner face;

(b) said top of said second side panel further comprises a flange extending substantially normal to said outer face and said bottom of said second side panel further comprises a flange extending substantially normal to said inner face; and (c) said top of said rear panel further comprises a flange extending substantially normal to said outer face and said bottom of said rear panel further comprises a flange extending substantially normal to said inner face.

Preferably the pit form further comprises at least one stabilizer on at least one of said panels.

In one aspect of the invention the side panel connector further comprises at least one stabilizer, preferably substantially rectangular in shape.

Preferably the pit form further comprises at least one mounting plate, proximate said first end of at least one of said first and said second side panels, and preferably proximate said side panel connector, and preferably said at least one mounting plate is substantially normal to said first end of at least one of said first and said second side panels.

Preferably the pit form further comprises at least one bumper located thereon, preferably said at least one bumper is located on said at least one mounting plate.

According to another aspect of the invention, there is provided a method of assembling a pit form for forming a pit, said pit form comprising:

(a) a first side panel having a top, a bottom, a first end, a second end, an outer face for contact with poured concrete to form a mold surface therefor, an opposite inner face for lining said pit, and at least one connector located proximate at least one end thereof;

(b) a second side panel arranged in a substantially parallel relationship to said first side panel, said second side panel having a top, a bottom, a first end, a second end, an outer face for contact with poured concrete to form a mold surface therefor, an opposite inner face for lining said pit, and at least one connector located proximate at least one end thereof;

(c) a rear panel having a top, a bottom, a first end, a second end, an outer face for contact with poured concrete to form a mold surface therefor, an opposite inner face for lining said pit, and at least one connector receiver for receiving each of said at least one connector of each of said first and said second side panels; whereby when each of said at least one connector of each of said first and said second side panels is received within said at least one connector receiver, said rear panel is arranged substantially perpendicular to each of said first and said second side panels and said second side panel is arranged substantially parallel to said first side panel and is located at a predetermined distance therefrom; whereby the method comprises:

(i) aligning said at least one connector of said first side panel with said at least one connector receiver of said rear panel and inserting said at least one connector of said first side panel into said at least one connector receiver of said rear panel and (ii) aligning said at least one connector of said second side panel with said at least one connector receiver of said rear panel and inserting said at least one connector of said second side panel into said at least one connector receiver of said rear panel, thereby assembling a pit form.

Preferably said pit form further comprises a side panel connector for connecting each of said first and said second side panels proximate the first end of each of said first and said second side panels and wherein the method further comprises: securing said side panel connector proximate the first end of each of said first and said second side panels, and preferably the pit form further comprises at least one mounting plate and wherein the method further comprises: securing said at least one mounting plate to said pit form.

Preferably the method further comprises: securing said at least one mounting plate proximate and substantially normal to said first end of at least one of said first side panel and said second side panel, and preferably the pit form further comprises at least one bumper and wherein the method further comprises securing said at least one bumper to said at least one mounting plate.

DETAILED DESCRIPTION OF THE DRAWINGS

Referring now to the figures for a typical arrangement, the prefabricated pit form according to a preferred embodiment of the present invention comprises three interconnecting panels which are adapted for connection in an edge-to-edge upstanding configuration. When so connected the panels circumscribe a space and define a substantially rectangular concrete form for the pouring of concrete to provide a loading dock pit or the like.

Figure 11:
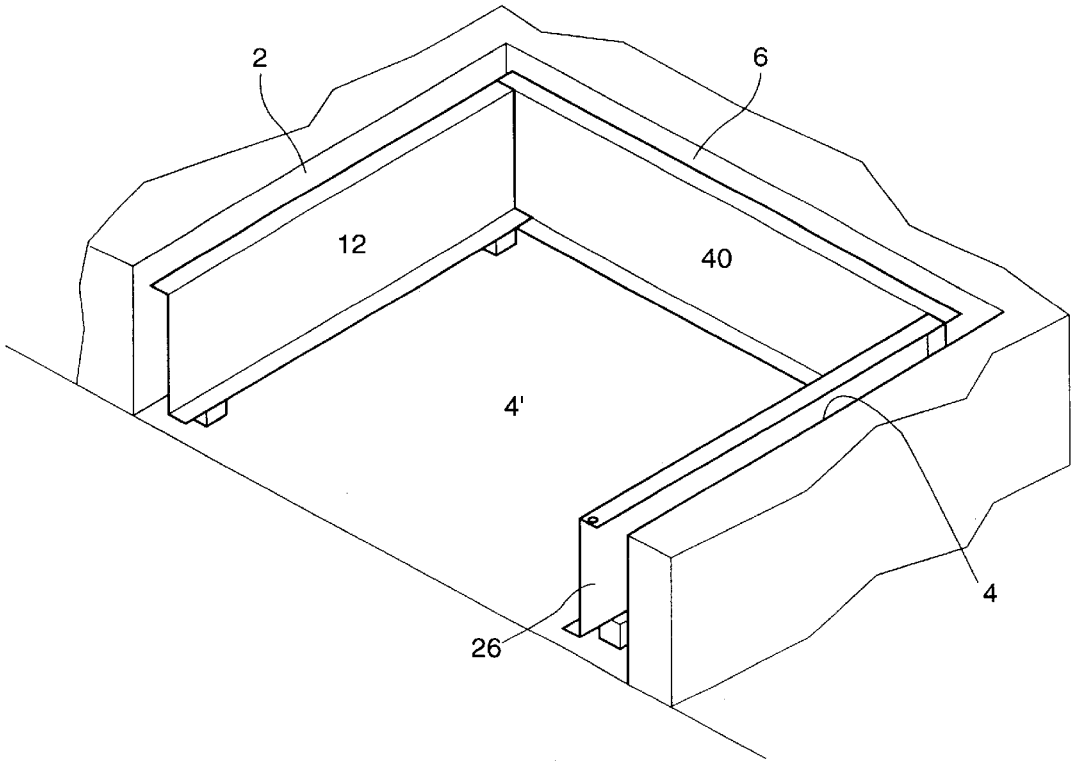
FIG. 11 is a perspective view of the pit form when installed in the platform surface of a typical loading dock prior to pouring of concrete in one embodiment.

In one embodiment of the pit form 10 is shown assembled to form a pit 5 in the platform surface 4' of a typical loading dock. The pit is defined by a substantially horizontal base surface, upstanding side walls 2 and 4 and an upstanding rear wall 6 (See FIG. 11). The top and front of the pit are open. The open front of the pit is flush with the depending dock face (not shown) and front wall 7 (partially cut away) of the loading dock, and the pit base surface is elevated relative to the driveway approach (not shown) on which the vehicle is parked when located at the loading dock. The pit 5 is wider than a conventional dock pit to accept the pit form 10.

Figure 3:
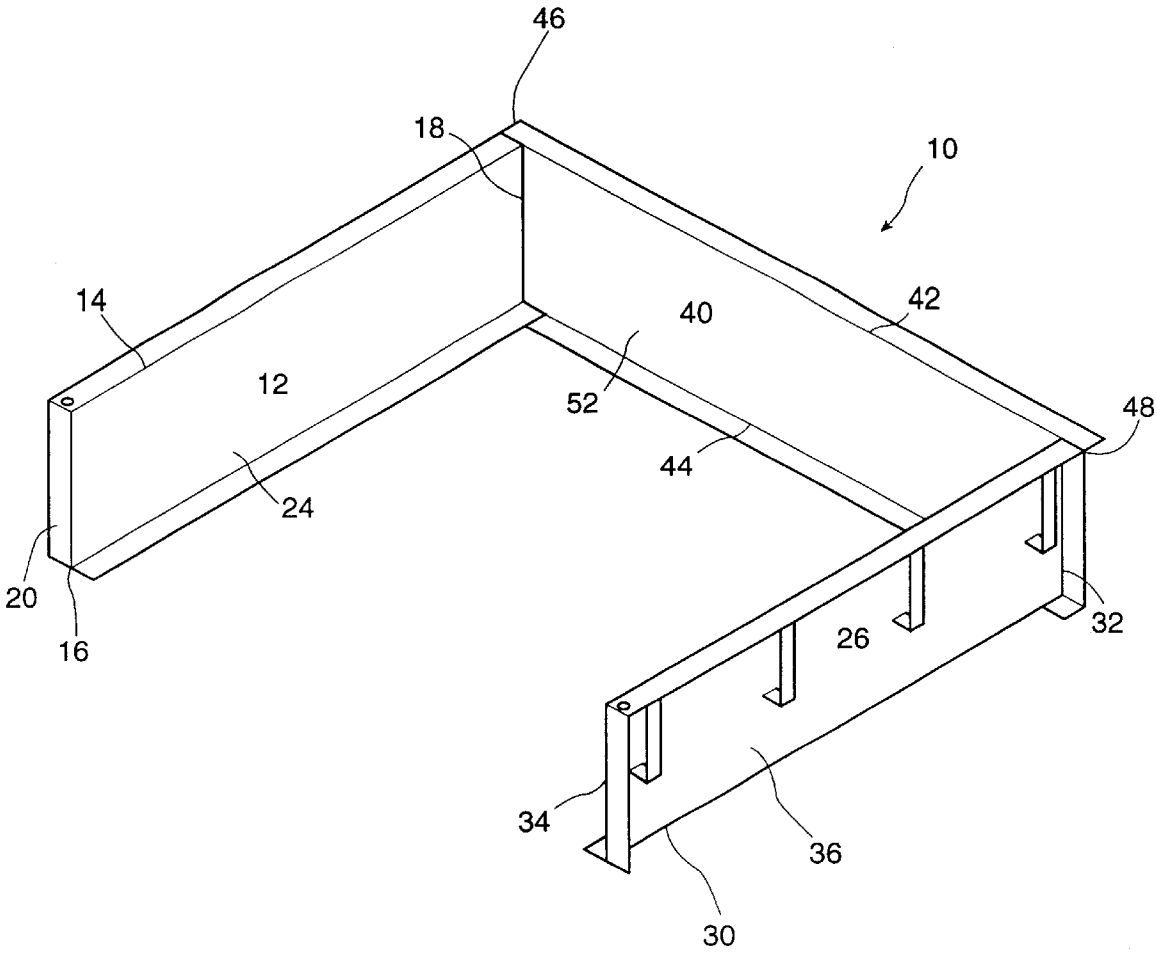
FIG. 3 is a perspective view of the pit form when the side panels and rear panel are assembled in one embodiment.
Figure 4:
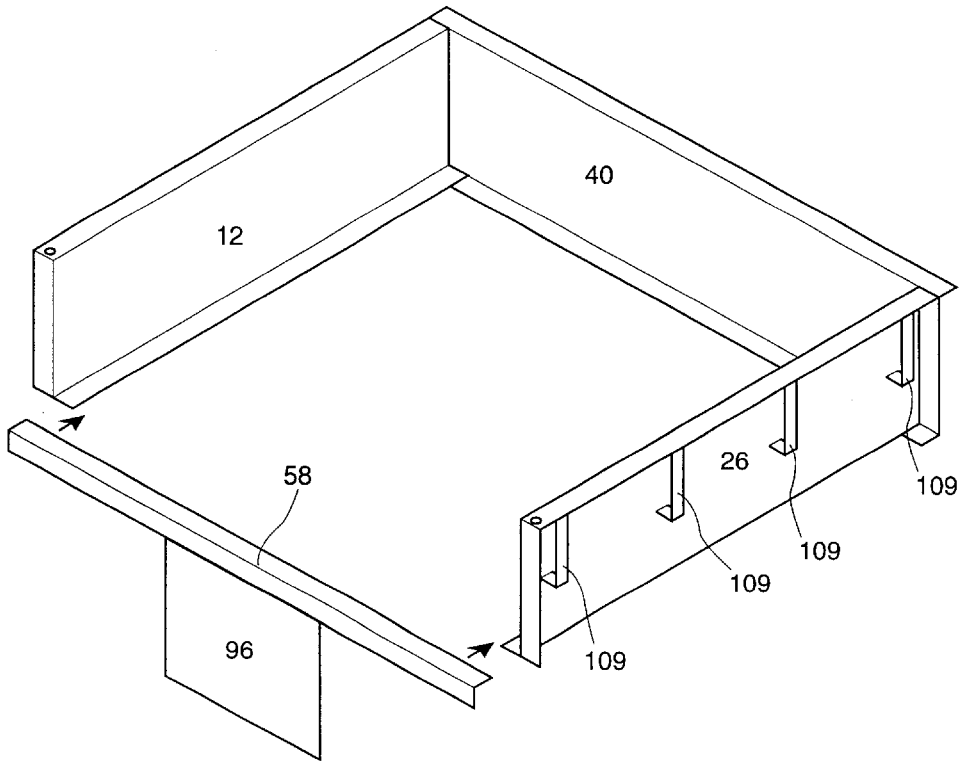
FIG. 4 is a perspective view of the pit form depicting the addition of the side panel connector with the front mounting plate to the pit form of FIG. 3 in one embodiment.

As shown in FIG. 3, the pit form 10 comprises a first side panel 12, a second side panel 26, and a rear panel 40 which combine to form three sides of the pit form 10. The front of pit form 10 is open to allow access from outside the loading dock to inside the loading dock via the opening. First side panel 12 has a top 14, a bottom 16, a first end 18, a second end 20, an outer face 22 and an opposite inner face 24. Second side panel 26 has a top 28, a bottom 30, a first end 32, a second end 34, an outer face 36 and an opposite inner face 38. Rear panel 40 has a top 42, a bottom 44, a first end 46, a second end 48, an outer face 50 and an opposite inner face 52. The side panels also have an electrical wiring aperture, if required, i.e. for a hydraulic dock leveler, or any other electrical requirement operation. The individual panels are releasably held together by connectors at the corners of the pit form 10 in a manner to be described hereinafter.

Figure 6:
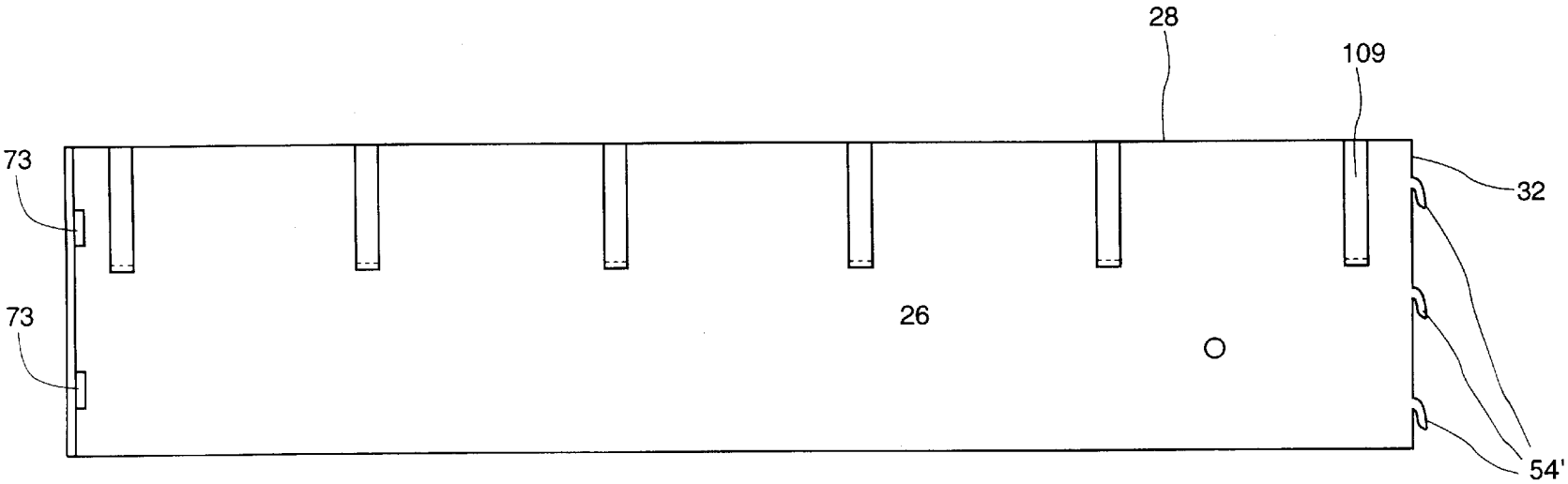
FIG. 6 is a plan of the outer face of a side panel in one embodiment.
Figure 7:
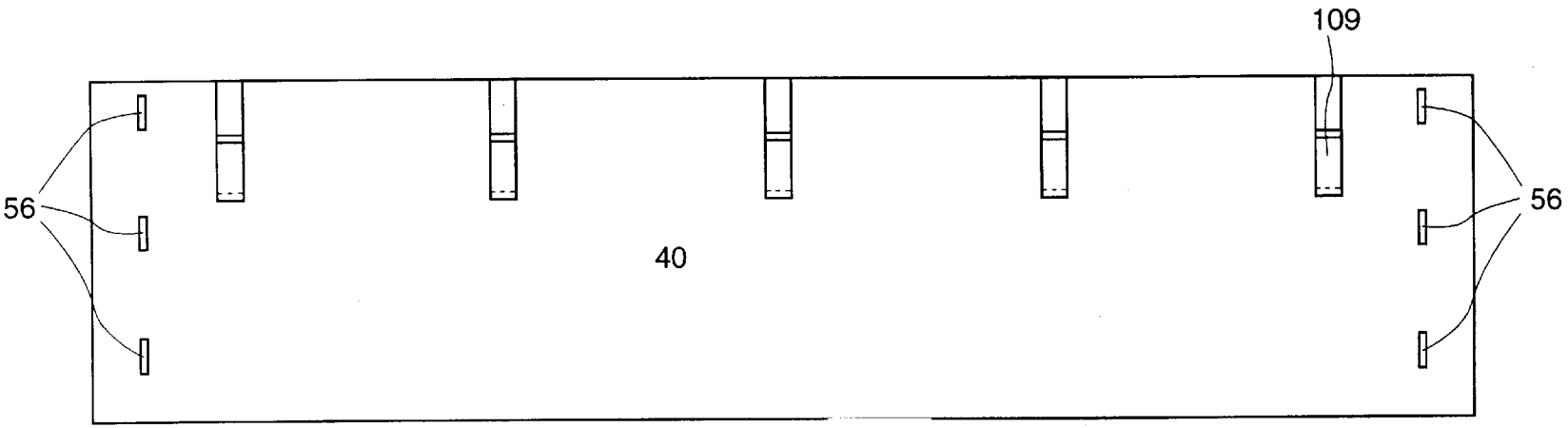
FIG. 7 is a plan view of the outer face of the rear panel in one embodiment.
Figure 16:
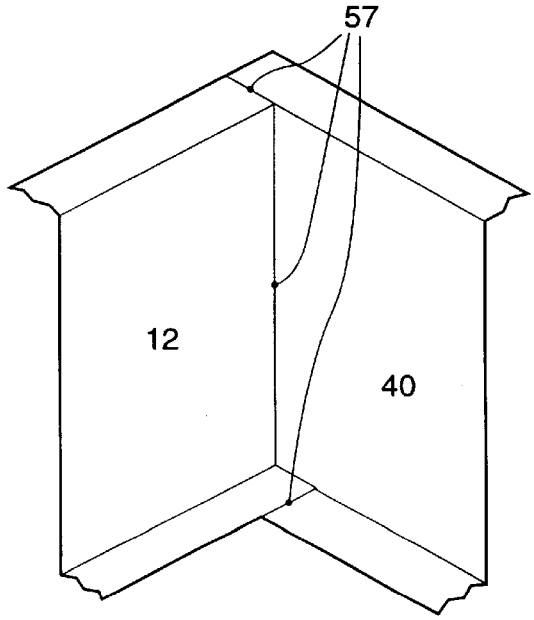
FIG. 16 depicts the spot welding areas of the side and rear panel in one embodiment.

Referring now to the FIGS. 6 and 7, the pit form 10 and the interrelationship of the individual components is illustrated. First side panel 12 has a plurality of connectors 54 preferably disposed along the first end 18 of the first side panel 12 in a vertically spaced apart relationship. Second side panel 26 has a plurality of connectors 54' disposed along the first end 32 of the second side panel 26 in a vertically spaced apart relationship. Only one side panel is shown in FIG. 6, since first side panel 12 and second side panel 26 are mirror images of each other in this embodiment. In this embodiment, the connectors 54 and 54' are hooked shaped tabs extending outwardly from the first ends 18 and 32 and projecting substantially parallel to the side panels 12 and 26 downwardly away from the top ends 14 and 28 thereof. As best seen in FIG. 7, rear panel 40 has a plurality of connector receivers in this embodiment being in the form of slots 56 which are disposed at or near both the first end 46 and second end 48 of the rear panel 40 in a vertically spaced apart relationship. The slots 56 are adapted in length to received the connectors 54 and 54' and securely connect the first and second side panels 12 and 26, respectively with the rear panel 40 in a substantially, aligned and perpendicular arrangement. The connectors 54 and 54' of the first side panel 12 and the second side panel 26 are received in the corresponding slots 56 of the rear panel 40 in a secure, substantially aligned and perpendicular arrangement to said rear panel 40. When first side panel 12 and second side panel 26 are positioned in a parrallel relationship to each other and are each further positioned in a perpendicular relationship to rear panel 40, the connectors 54 and 54' each of the first side panel 12 and the second side panel 26 are aligned with the slots 56 of rear panel 40. The first and second side panels 12 and 26, respectively are secured to the rear panel 40 by insertion of connectors 54 and 54' of each of the first side panel 12 and the second side panel 26 into the slots 56 in the rear panel 40 by inserting the hooked shaped tabs into the vertically elongated slots. After the first and second side panels 12 and 26, respectively are connected with the rear panel 40 and are substantially flush, the side panels 12 and 26 of the pit form 10 may be permanently connected to said rear panel 40 by spot welds 57 as best seen in FIG. 16, or by any other suitable method.

Figure 15:
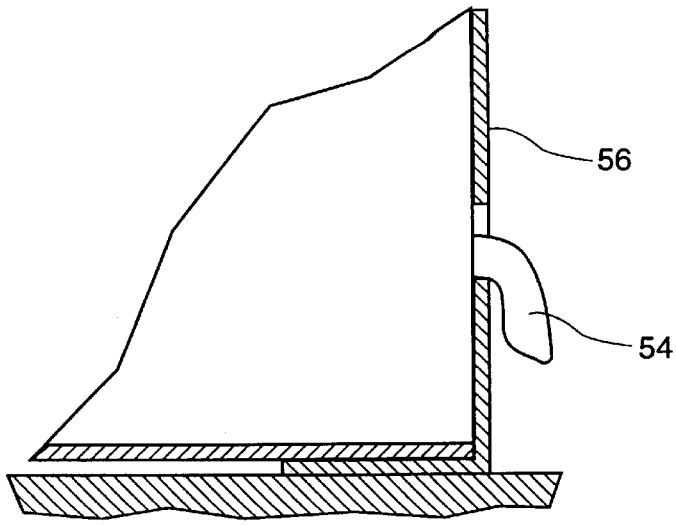
FIG. 15 depicts the unique attachment of the side panel to the rear panel in one embodiment.

As best seen in FIG. 15, the connectors 54 and 54' are hook shaped tabs connected to elongated slots 56. It will be evident however, that the connectors 54 and 54' and the slots 56 may take the form of any other type of connectors and connector receivers which exhibit the features of the present invention, namely providing for substantially self-alignment and secure perpendicular arrangement of the side panels with the rear panels. While on each side panel 12 and 26, three connecting members 54 and 54' have been shown and three slots 56 have been shown at each end of the rear panel 40, a greater number or less number of connectors 54 and 54' and slots 56 may also be used, depending on the size of the panels.

Figure 1:
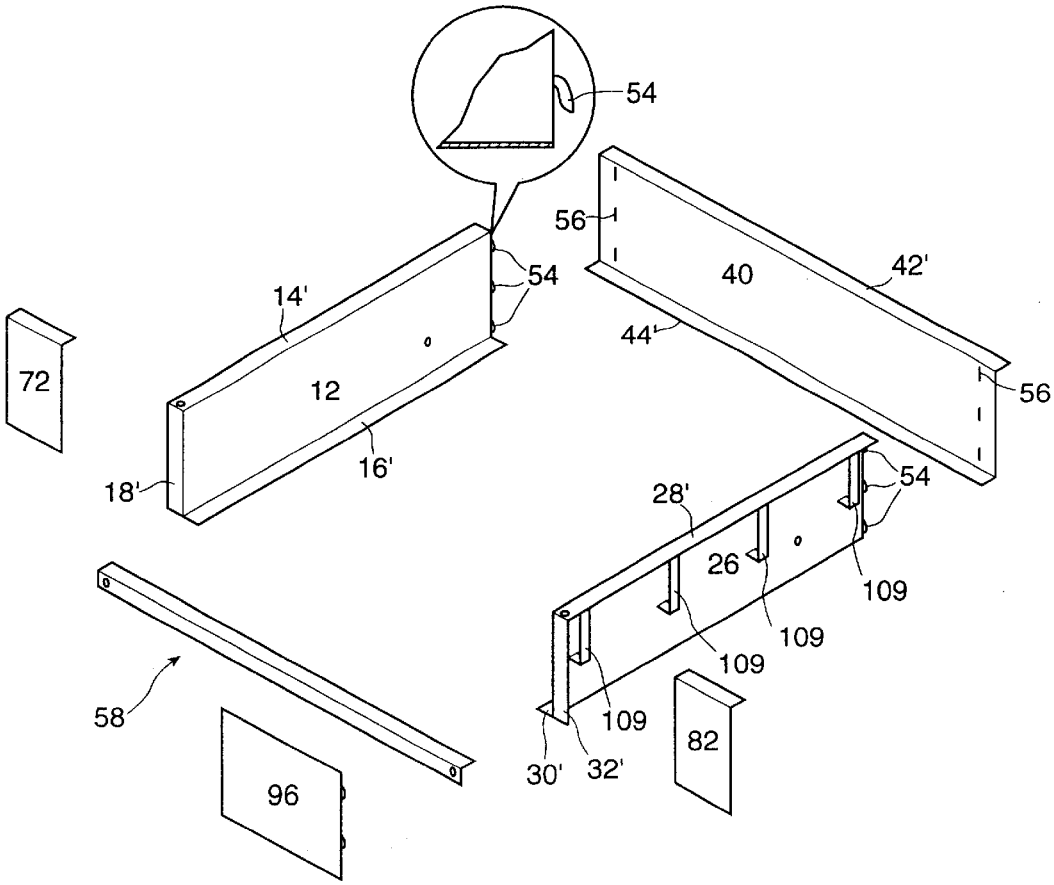
FIG. 1 is an exploded view of a pit form illustrated according to a preferred embodiment of the invention.
Figure 2:
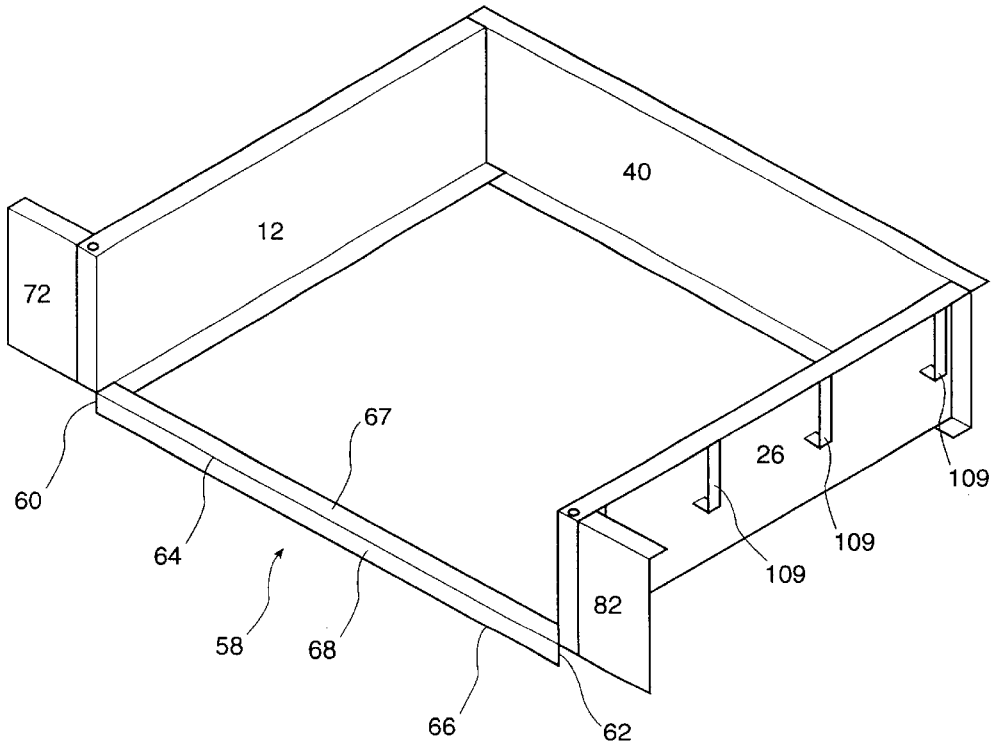
FIG. 2 is a perspective view of the pit form when assembled according to one embodiment of the present invention.
Figure 8:
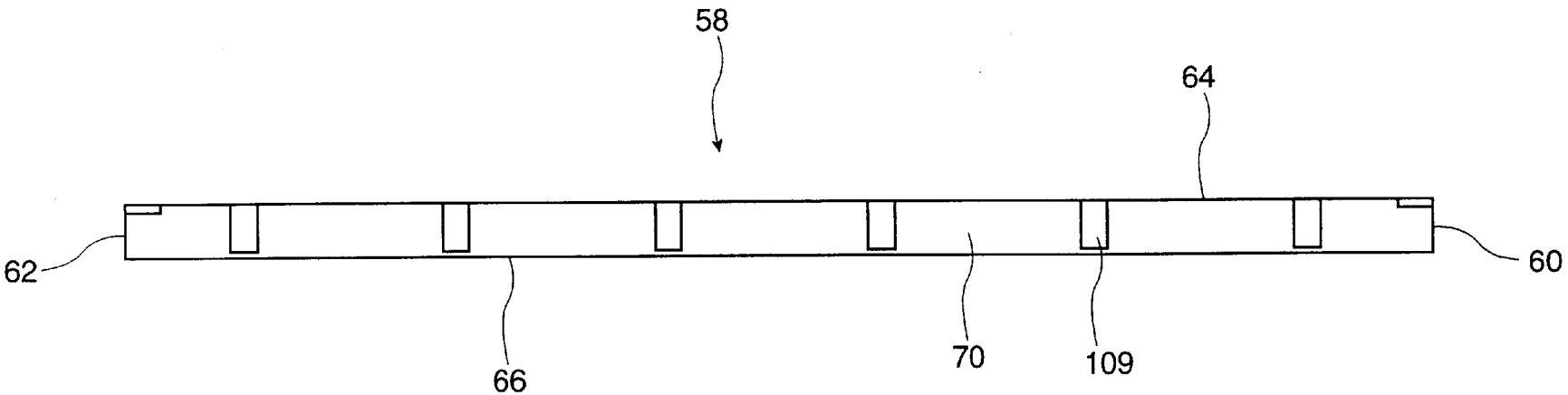
FIG. 8 is an view of the side panel connector in one. embodiment.

Referring now to FIGS. 2 and 8, another embodiment of the pit form 10 is shown further comprising a side panel connector 58. In this embodiment, the side panel connector 58 has first end 60, a second end 62, a top 64, a bottom 66, an outer face 68, an inner face 70, and a flange 67 at said top 64, said flange 67 projecting substantially normal to said outer face 68. The side panel connector 58 is adapted in length to span the entire width of the pit form 10 such that the flange 67 connects the bottom 16 of the first side panel 12 with the bottom 30 of the second side panel 26 proximate the first ends 18 and 32, respectively of the first and second side panel 12 and 26. The installed side panel connector 58 serves to rigidify and stabilize the entire pit form 10 during use to resist the pressure of the poured concrete. In addition to providing reinforcement and stability for the entire pit form 10, the side panel connector 58 is also adapted to act as a curb angle between the dock face and the interior of the pit. In the illustrated case, the side panel connector 58 is L-shaped. It will be evident however, that the side panel connector 58 could take the form of any type of reinforcing structure and be made of any suitable material.

The pit form 10 is shown further comprising flanges in conjunction with first and second side panels 12 and 26, respectively and rear panel 40. The top 14 of the first side panel 12 has a flange 14' extending substantially normal and substantially away from to the outer face 22 of the first side panel 12. The bottom 16 of the first side panel 12 has a flange 16' extending substantially normal to and substantially away from the inner face 24 of the first side panel 12. The first end 18 of the first side panel 12 has a flange 18' extending substantially normal to and substantially away from the outer face 22 of the first side panel 12. The top 28 of the second side panel 26 has a flange 28' extending substantially normal to and substantially away from the outer face 36 of the second side panel 26. The bottom 30 of the second side panel 26 has a flange 30' extending substantially normal to and substantially away from the inner face 38 of the second side panel 26. The first end 32 of the second side panel 26 has a flange 32' extending substantially normal to and substantially away from the outer face 36 of the second side panel 26. The top 42 of the rear panel 40 has a flange 42' extending substantially normal to and substantially away from the outer face 50 of the rear panel 40. The bottom 44 of the rear panel 40 has a flange 44' extending substantially normal to and substantially away from the inner face 52 of the rear panel 26. Flanges 14', 16', 30', 32', 42' and 44' are adapted in length to substantially span the entire length of each panel. Flanges 18' and 32' are adapted in length to substantially span the entire height of each of the first side panel 12 and the second side panel 26. The flanges serve to rigidify and stabilize the entire panel during use to resist pressures of the poured concrete. In addition to providing reinforcement and stability for each panel, flanges 14', 16', 30', 32', 42' and 44' are adapted to act as a curb angle between the platform surface and the interior of the pit. As well, flanges 18' and 32' are adapted to act as a curb angle between the dock face and the interior of the pit.

Figure 5:
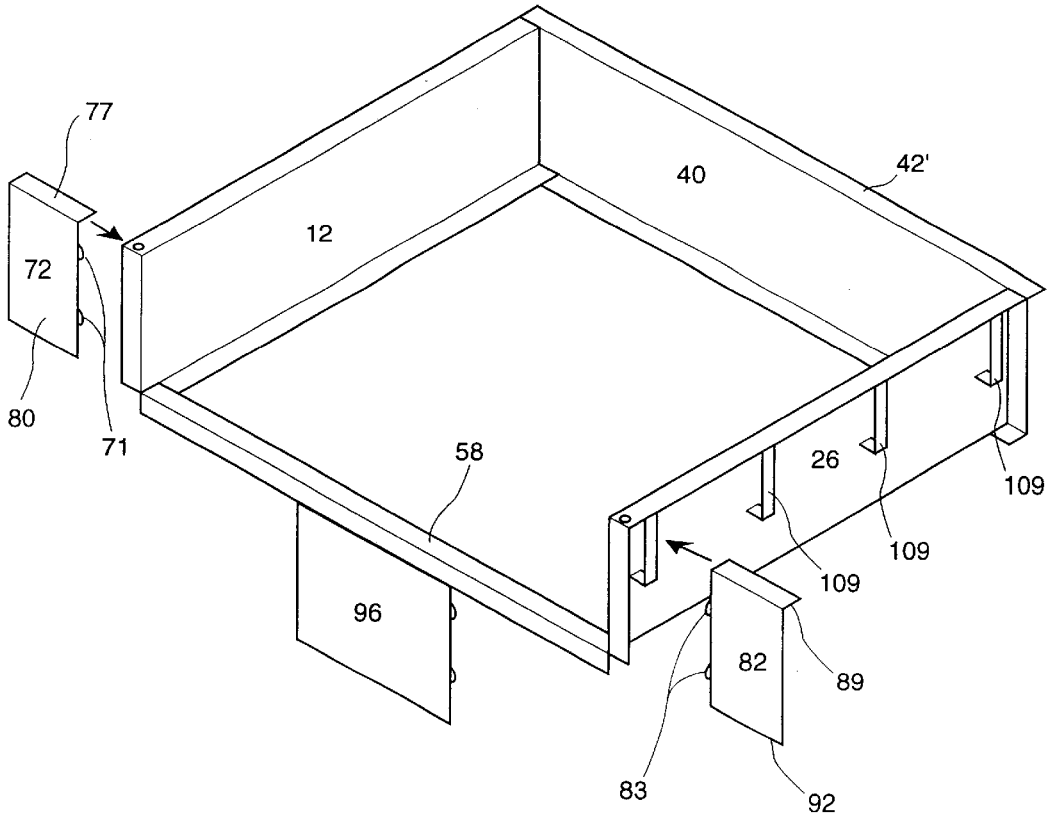
FIG. 5 a perspective view of the pit form depicting the addition of the side mounting plates the pit form of FIG. 4 in one embodiment.
Figure 9:
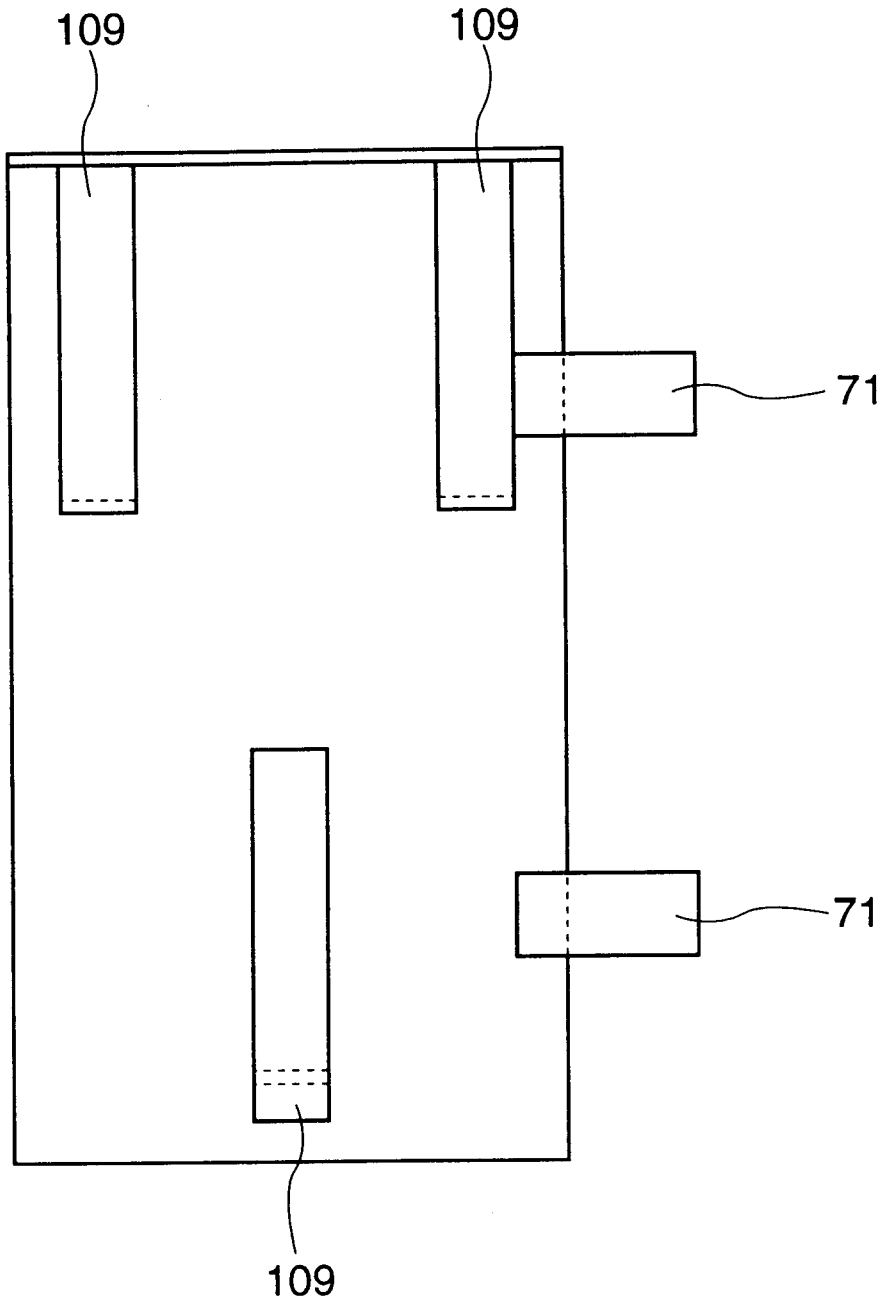
FIG. 9 is a view of the side mounting plate in one embodiment.

Referring now to FIGS. 2, 5 and 9, another embodiment of the pit form 10 is shown further comprising a first mounting plate 72 in conjunction with first side panel 12 and a second mounting plate 82 in conjunction with second side panel 26. In this embodiment, the first mounting plate 72 has flange 77 at said top, said flange 77 projecting substantially normal to and substantially away from the outer face 80. The second mounting plate 82 has a flange 89 at said top, said flange 89 projects substantially normal to and substantially away from the outer face 92. Plates 72 and 82 are L shaped in this embodiment. One end of the first mounting plate 72 is provided with two tabs 71 and is secured to the first end 18 of the first side panel 12 by two sleeves 73 (See FIG. 6) by receiving the two tabs 71 such that the first mounting plate 72 projects substantially normal the outer face 22 of the first side panel 12. One end of the second mounting plate 82 is provided with two tabs 83 and is secured to the first end 32 of the second side panel 26 by two sleeves 85 by receiving the two tabs 83 such that the second mounting plate 82 projects substantially normal to the outer face 36 of the second side panel 26. After the first and second mounting plates 72 and 82, respectively are interconnected with the first and second side panels 12 and 26, respectively by this means, they must be permanently interconnected by welding or any other suitable means.

The first and second mounting plates 72 and 82, respectively are adapted in length to span the entire height of the first and second side panels 12 and 26, respectively and thus the entire depth of pit form 10. The outer faces 80 and 92, respectively of the installed first and second mounting plates 72 and 82, respectively serve as a surface for mounting a bumper (not shown), preferably a conventional loading dock bumper. The bumpers, which are engaged by the rear of a vehicle (not shown) when the vehicle is backed into a parked position relative to the pit form, prevent the vehicle from striking and damaging the dock wall. In addition to providing a surface for mounting a bumper, the outer faces 80 and 92, respectively of the first and second mounting plates 72 and 82, respectively act as a curb angle between the dock face 3 and the interior of the pit. As well, flanges 77 and 89, respectively of the first and second mounting plates 72 and 82, respectively act as a curb angle between the platform surface and the interior of the pit.

In the illustrated case, the first and second mounting plates 72 and 82, respectively are L-shaped. It will be evident however, that the first and second mounting plates 72 and 82, respectively could take the form of any type of mounting structure.

Referring now to FIGS. 1, 4, 5 and 12, one embodiment of the pit form 10 is shown further comprising a third mounting plate 96 in conjunction with the side panel connector 58. In this embodiment, the third mounting plate 96 is secured to the bottom of the side panel connector 58 (preferably by welding) such that the third mounting plate 96 projects substantially parallel to the outer face 68 and downwardly from the bottom 66 of the side panel connector 58. The outer face of the installed third mounting plate 96 serves as a surface for mounting a vehicle restraint (not shown), preferably a conventional loading dock vehicle restraint. The vehicle restraint, which is engaged by the rear of a vehicle (not shown) when the vehicle is backed into a parked position relative to the pit from 10, prevents the vehicle from moving during loading and unloading operations. In the illustrated case, the third mounting plate 96 is a flat steel plate. It will be evident however, that the third mounting plate 96 could take the form of any type of mounting structure.

Figure 12:
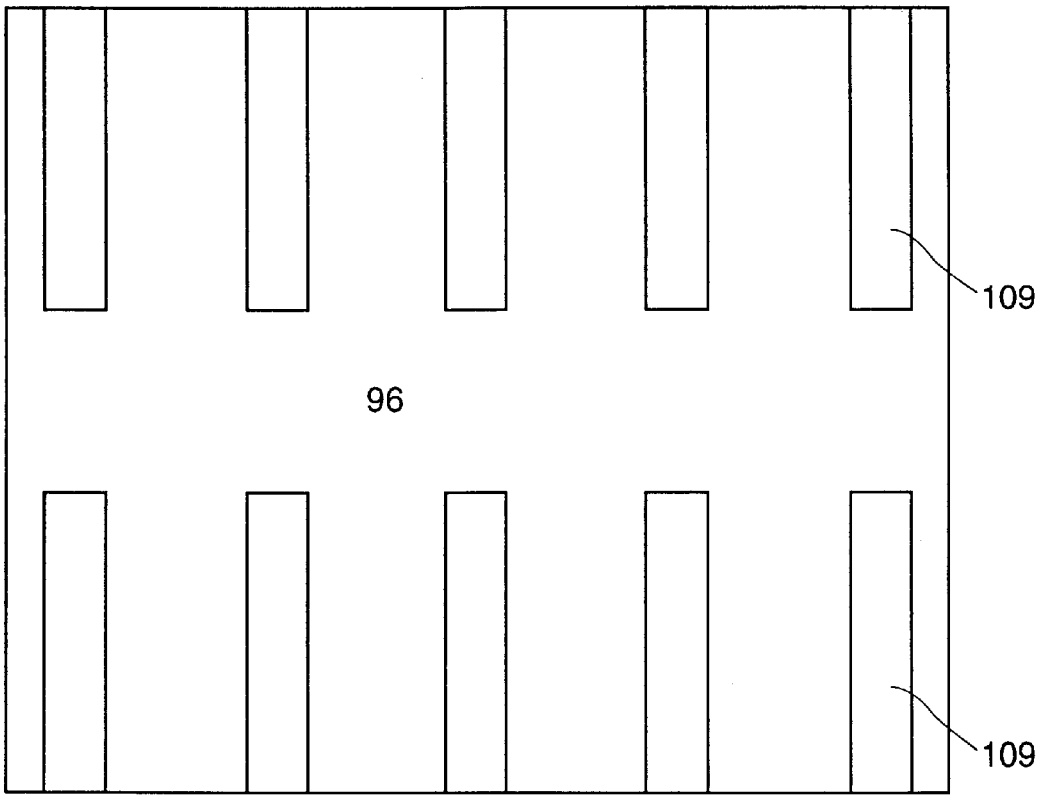
FIG. 12 is a rear plan view of the mounting plate attached to the side panel connector in one embodiment.

In one embodiment, as per the Figures, the pit form 10 is shown further comprising stabilizers 109 in conjunction with panels 12, 26 and 40. The first side panel 12 has a plurality of stabilizers 109 disposed along the outer face 22 of the first side panel 12 in a horizontally spaced apart relationship. The second side panel 26 has a plurality of stabilizers 109 disposed along the outer face 36 of the second side panel 26 in a horizontally spaced apart relationship. The rear panel 40 has a plurality of stabilizers 109 disposed along the outer face 50 of the rear panel 40 in a horizontally spaced apart relationship. In this embodiment, the stabilizers 109 are preferably rectangular in shape, such that the vertical portion of the stabilizer 109 will be substantially embedded in the concrete serving to substantially stabilize the panels at two points from bowing or any other movement of the panels due to the fact that the vertical portion is connected at both its top and bottom to the panel with which it is associated with. Although rectangular in shape in this embodiment, the stabilizers 109 may take the form of any suitable securing structure which exhibits the qualities mentioned herein in the present invention. The stabilizers 109 serve to rigidify and stabilize each panel during use to resist the pressure of the poured concrete. In addition to providing reinforcement and stability for each panel, the stabilizers 109 are to secure each panel within the concrete, such that any movement of the panels within the concrete is minimized. Similarly as seen in FIG. 9 and FIG. 12, the mounting plates also have stabilizers 109. having six stabilizers 109 disposed along their outer faces 22 and 36, respectively in a horizontally spaced apart relationship. Furthermore, the rear panel 40 is shown having five stabilizers 109 disposed along it outer face 50 in a horizontally spaced apart relationship. It will be evident however, that the number of stabilizers 109 disposed along the outer faces of the panels may vary as required. The mounting plates 72, 82 and 96 and side panel connector 58 may also have stabilizers located thereon.

Figure 10:
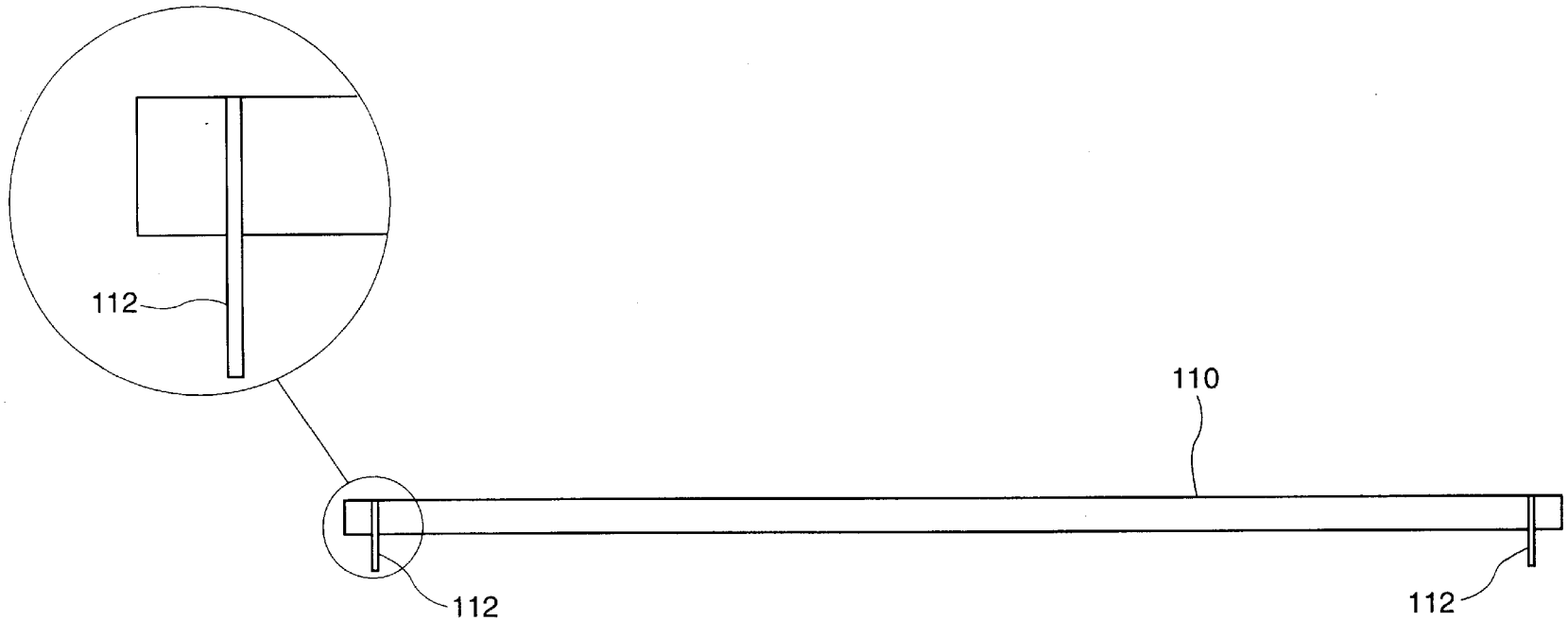
FIG. 10 is a view of the brace in one embodiment.
Figure 13:
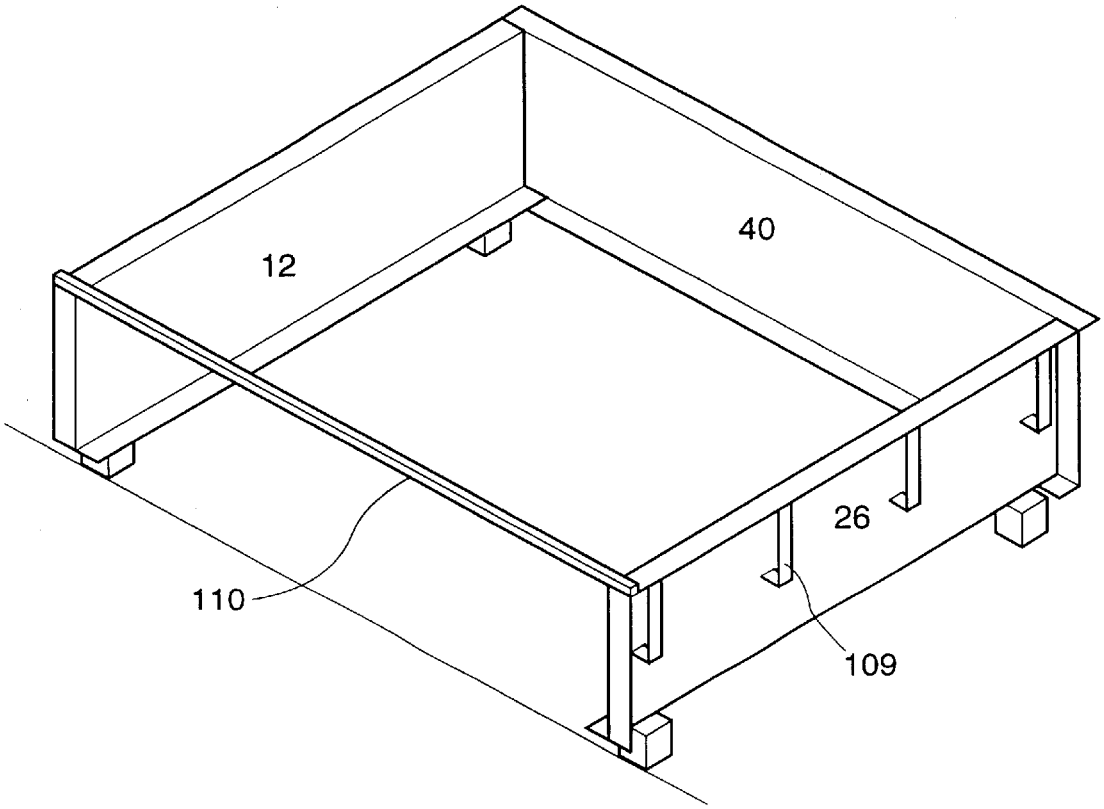
FIG. 13 depicts the pit form with the brace in place in one embodiment.

Referring now to FIGS. 10 and 13, one embodiment of the pit form 10 is shown further comprising a brace 110. The brace 110 is adapted in length to span the entire width of the pit form 10 and connect the top 14 of the first side panel 12 with the top 28 of the second side panel 26 proximate the first ends 18 and 32, respectively of the first and second side panels 12 and 26, respectively. The brace 110 is removably secured to the tops 14 and 28, respectively of each of the first side panel 12 and the second side panel 26 by in this instance, a pair of dowels 112 each being proximate the first ends and second ends thereof, each extending downwardly from the bottom thereof. Each of said dowels are received by an aperture located on each of said flanges of said first and second side panels. The installed brace 110 serves to rigidify and stabilize the entire pit form 10 during the formation of a pit to resist the pressure of the poured concrete (i.e. resists the side panels from collapsing during the pouring of the concrete). Once the concrete has cured, the brace 110 may be removed. In the illustrated case, the brace 110 is a steel bar. It will be evident however, that the brace 110 could take the form of any type of reinforcing structure.

Figure 14:
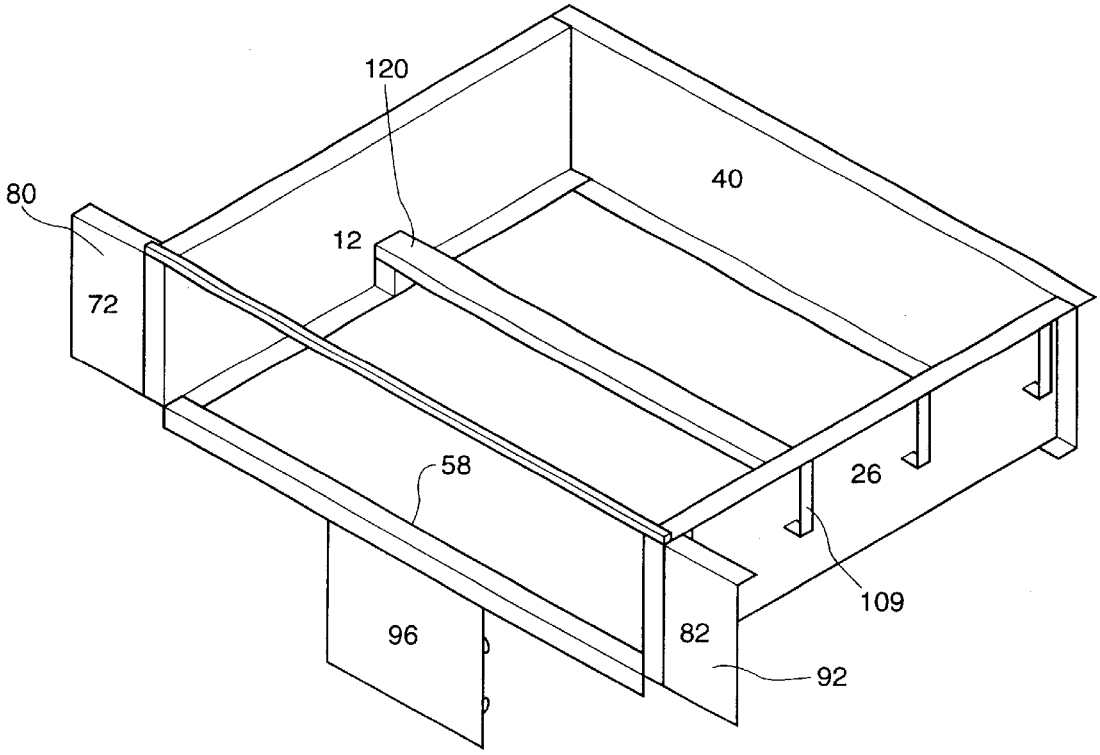
FIG. 14 depicts the pit form with the spacer in place in one embodiment.

Referring now to FIG. 14, one embodiment of the pit form 10 is shown further comprising a spacer 120. In this embodiment, the spacer 120 is a wooden. The spacer 120 is adapted in length to span the entire width of the pit form 10 and fixing the distance between the bottom flange 16' of the first side panel 12 and the bottom flange 30' of the second side panel 26 substantially intermediate the first and second ends 18, 20 and 32, 34, respectively of the first and second side panels 12 and 26, respectively. The spacer 120 is secured to the bottom flanges 16' and 30', respectively of each of the first side panel 12 and the second side panel 26 by a friction fit in this instance. The installed spacer 120 serves to rigidify and stabilize the entire pit form 10 during the formation of a pit to resist the pressure of the poured concrete (i.e. resists the collapsing of the side panels inwardly during the pouring of the concrete). Once the concrete has cured, the spacer 120 may be removed.

The preferred material for each of the elements described above is a structurally suitable steel such as 12 gauge steel or the like, and may advantageously be formed by well known processes. However, any appropriate metal or any other effective material which meet the requirements of the invention may be used.

A typical setup method is described below.

Step 1 Pit Preparation

Remodeled Pit

Pit opening must be cut 12" wider than the finished pit width and 9" longer than the finished pit length. The pit opening-depth must be (24 ½" or 28 ½") from the top of finished floor.

New Construction Pit

Place four supports (bricks or block) near the pit's four corners. These brick supports (or, blocks) will provide a temporary flat surface to keep the pan assembly in place while concrete is being poured. Use shims to adjust the pan assembly height.

Step 2 Pit Form

The side member has three "quick-hook-together" tabs. Align the tabs with the slots of the rear plate and snap them in place. Repeat this step for the other side.

Observe that the top of the side plates and rear member are flush.

Use a square in rear corner to ensure squareness of box. Tack weld each corner.

Tack weld the mating corners of the rear and side plates. Run two 3" continuous welds on top of the panels where they meet. Run stitch welds along the quick-together-tabs and rear panel's slots.

Step 3 Setting the Pit Form

Install top front steel brace (insert the dowels into the holes of the side panels).

For a Remodelled Pit

Clamp the 2"×4" support boards to the side panels to hang the pit form from the existing dock floor.

Align electrical conduit with the hole in the right-side panel (looking from outside the building in) and slide through pre-bored hole.

For a New Construction Pit

Place the panel assembly on top of the four bricks/blocks, or the like. Fasten the assembly anchors to the existing re-bar.

Square and level the assembly.

Step 4 Squaring the Assembly

Snap the front curb angle (either 3"×3"×3/16" or 4"×4"×¼") and available mounting plate over the front-tabs of the side panel(s) of the pit form.

Slide optional bumper mounting plates (I left, I right) into position. Ensure they are square with the pit form and tack-weld into position. The pit form is assembled.

Step 5 Pouring Concrete

Place the 2"×4" brace assembly in place.

For a remodeled pit pour concrete around the pit form, then to the pit floor.

For a new construction pit pour concrete to the pit floor. Second, pour concrete around the pit form sides.

Level and finish off all areas where concrete was poured.

Remove all weld spatter and residue, and apply grey rust paint to the pit form welded and scratched areas.

While the panels may be made in a number of different sizes as previously mentioned, in a typical case, the side panels are fabricated in standard lengths, for example 63, 87, 111 or 135-inch lengths which are adapted for the forming of the concrete side walls of typical loading dock pits. As well, the rear panel may be fabricated in a number of standard lengths, for example 80, 86, or 91-inch lengths which are adapted for the forming of the concrete rear wall of typical loading dock pits. In this versatile manner, the panels are adapted for assembly to virtually any dimension or configuration of loading dock pit desired while at the same time permitting manufacturers, suppliers or users of such panels to stock a reduced inventory of sizes.

As many changes can be made to the preferred embodiments of the invention without departing form the scope of the invention; it is intended that all material contained herein be interpreted as illustrative of the invention and not in a limiting sense.

The embodiments of the invention in which an exclusive property or privilege is claimed are as follows:

1. A pit form comprising two substantially parallel side members, each of said side members having two ends, an outer face for contact with poured concrete to form a mold surface therefor and at least one male or female engaging portion; and a substantially perpendicular rear member extending between ends of the side members in use, said rear member having two ends, an outer face for contact with poured concrete to form a mold surface therefor and at least one engaging portion located proximate each of said two ends, said at least one engaging portion being compatible with that of said at least one male or female engaging portion of said side members to interconnect said ends of said members to form said pit form.

2. A pit form comprising:

(a) a first side panel having a first end, a second end, an outer face for contact with poured concrete to form a mold surface therefor, an opposite inner face for lining said pit, and at least one connector located proximate at least one end thereof;

(b) a second side panel for arranging in a substantially parallel relationship to said first side panel, said second side panel having a first end, a second end, an outer face for contact with poured concrete to form a mold surface therefor, an opposite inner face for; lining said pit, and at least one connector located proximate at least one end thereof;

(c) a rear panel for arranging in a substantially perpendicular relationship to said first and said second side panels and extending between ends of said side panels, said rear panel having a first end, a second end, an outer face for contact with poured concrete to form a mold surface therefor, an opposite inner face for lining said pit, and at least one connector receiver located proximate each of said first and said second end, said at least one connector receiver for receiving each of said at least one connector of each of said first and said second side panels; whereby when each of said first and said second side panels are arranged substantially parallel to one another and said rear panel is arranged substantially perpendicular to each of said first and said second side panels and extending between proximate the same ends of said side panels, said at least one connector of said side panels will engage said at least one connector receiver of said rear panel thereby connecting said ends of said panels and forming said pit form.

3. The pit form of claim 2 wherein the at least one connector of each of said first and said second side panels is located proximate the second end of each of said first and said second side panels, said pit form further comprising a side panel connector for connecting each of said first and said second side panels proximate the bottom of the first end of each of said first and said second side panels.

4. The pit form of claim 2 or 3 wherein each of said first and said second side panels and said rear panel has a top and a bottom wherein:

(a) said top of said first side panel further comprises a flange extending substantially normal to said outer face and said bottom of said first side panel further comprises a flange extending substantially normal to said inner face;

(b) said top of said second side panel further comprises a flange extending substantially normal to said outer face and said bottom of said second side panel further comprises a flange extending substantially normal to said inner face; and (c) said top of said rear panel further comprises a flange extending substantially normal to said outer face and said bottom of said rear panel further comprises a flange extending substantially normal to said inner face, said flanges enhancing the stability of said pit form when formed.

5. The pit form of claim 2 or 3 further comprising at least one stabilizer on at least one of said panels.

6. The pit form of claim 4 further comprising at least one stabilizer on at least one of said panels.

7. The pit form of claim 2 or 3 further comprising at least one mounting plate.

8. The pit form of claim 4 further comprising at least one mounting plate.

9. The pit form of claim 7 wherein said at least one mounting plate is disposed proximate said first end of at least one of said first and said second side panels.

10. The pit form of claim 8 wherein said at least one mounting plate is disposed proximate said first end of at least one of said first and said second side panels.

11. The pit form of claim 7 wherein said at least one mounting plate is disposed proximate said side panel connector.

12. The pit form of claim 8 wherein said at least one mounting plate is disposed proximate said side panel connector.

13. The pit form of claim 7 wherein the at least one mounting plate provides a surface for mounting at least one loading dock bumper thereon.

14. A method of assembling the pit form of claim 2, said method comprising:

(a) providing said first side panel;

(b) providing said rear panel and arranging said rear panel in a substantially perpendicular relationship to said first side panel;

(c) aligning said at least one connector of said first side panel with said at least one connector receiver of said rear panel and inserting said at least one connector of said first side panel into said at least one connector receiver of said rear panel;

(d) providing said second side panel and arranging said second side panel in a substantially parallel relationship to said first side panel and in a substantially perpendicular relationship to said rear panel; and (e) aligning said at least one connector of said second side panel with said at least one connector receiver of said rear panel and inserting said at least one connector of said second side panel into said at least one connector receiver of said rear panel, thereby assembling the pit form.

15. The method of claim 14, wherein said pit form further comprises a side panel connector for connecting each of said first and said second side panels proximate the first end of each of said first and said second side panels and wherein the method further comprises: securing said side panel connector proximate the first end of each of said first and said second side panels.

16. The method of claim 14 or 15 wherein the pit form further comprises at least one mounting plate and wherein the method further comprises: securing said at least one mounting plate to said pit form.

17. The method of claim 16 wherein the method further comprises: securing said at least one mounting plate proximate and substantially normal to said first end of at least one of said first side panel and said second side panel.

18. The method of claim 17 wherein the pit form further comprises at least one loading dock bumper and wherein the method further comprises securing said at least one loading dock bumper to said at least one mounting plate.

19. In combination with a loading dock, a pit form comprising:

(a) a first side panel having a first end, a second end, an outer face for contact with poured concrete to form a mold surface therefor, an opposite inner face for lining said pit, and at least one connector located proximate at least one end thereof;

(b) a second side panel for arranging in a substantially parallel relationship to said first side panel, said second side panel having a first end, a second end, an outer face for contact with poured concrete to form a mold surface therefor, an opposite inner face for lining said pit, and at least one connector located proximate at least one end thereof;

(c) a rear panel for arranging in a substantially perpendicular relationship to said first and said second side panels and extending between proximate the same ends of said side panels, said rear panel having a first end, a second end, an outer face for contact with poured concrete to form a mold surface therefor, an opposite inner face for lining said pit, and at least one connector receiver located proximate each of said first and said second end, said at least one connector receiver for receiving each of said at least one connector of each of said first and said second side panels; whereby when each of said first and said second side panels are arranged substantially parallel to one another and said rear panel is arranged substantially perpendicular to each of said first and said second side panels, and extending between proximate the same ends of said side panels said at least one connector of said side panels will engage said at least one connector receiver of said rear panel thereby connecting said ends of said panels and forming said pit form.

20. The combination of claim 19 wherein the at least one connector of each of said first and said second side panels is located proximate the second end of each of said first and said second side panels, said pit form further comprising a side panel connector for connecting each of said first and said second side panels proximate the first end of each of said first and said second side panels.

21. The combination of claim 19 or 20 wherein each of said first and said second side panels and said rear panel has a top and a bottom wherein:

(a) said top of said first side panel further comprises a flange extending substantially normal to said outer face and said bottom of said first side panel further comprises a flange extending substantially normal to said inner face;

(b) said top of said second side panel further comprises a flange extending substantially normal to said outer face and said bottom of said second side panel further comprises a flange extending substantially normal to said inner face; and (c) said top of said rear panel further comprises a flange extending substantially normal to said outer face and said bottom of said rear panel further comprises a flange extending substantially normal to said inner face, said flanges enhancing the stability of said pit form when formed.

22. The combination of claim 19 or 20 wherein the pit form further comprises at least one stabilizer on at least one of said panels.

23. The combination of claim 21 wherein the pit form further comprises at least one stabilizer on at least one of said panels.

24. The combination of claim 20 wherein the side panel connector further comprises at least one stabilizer.

25. The combination of claim 16 wherein the side panel connector further comprises at least one stabilizer.

26. The combination of claim 19 or 20 wherein the pit form further comprises at least one mounting plate.

27. The combination of claim 21 wherein the pit form further comprises at least one mounting plate.

28. The combination of claim 26 wherein said at least one mounting plate is disposed proximate said first end of at least one of said first and said second side panels.

29. The combination of claim 27 wherein said at least one mounting plate is disposed proximate said first end of at least one of said first and said second side panels.

30. The combination of claim 26 wherein the at least one mounting plate provides a surface for mounting at least one loading dock bumper thereon.

* * * * *